US005746181A

United States Patent [19]

Boecking et al.

[11] Patent Number: 5,746,181

[45] Date of Patent: May 5, 1998

[54] FUEL INJECTION VALVE FOR INTERNAL COMBUSTION ENGINES

[75] Inventors: Friedrich Boecking, Stuttgart; Stefan Haug, Leinfelden-Echterdingen, both of Germany

[73] Assignee: Robert Bosch GmbH, Stuttgart, Germany

[21] Appl. No.: 737,327

[22] PCT Filed: Feb. 9, 1996

[86] PCT No.: PCT/DE96/00203

§ 371 Date: Nov. 12, 1996

§ 102(e) Date: Nov. 12, 1996

[87] PCT Pub. No.: WO96/28656

PCT Pub. Date: Sep. 19, 1996

[30] Foreign Application Priority Data

Mar. 10, 1995 [DE] Germany ..... 195 08 636.8

[51] Int. Cl.[6] ..... F02M 55/02

[52] U.S. Cl. ..... 123/470

[58] Field of Search ..... 123/470

[56] References Cited

U.S. PATENT DOCUMENTS 5,394,850 3/1995 Murphy et al. ..... 123/470

5,479,900 1/1996 Bodenhausen et al. ..... 123/470

5,499,612 3/1996 Haughney ..... 123/470

5,520,151 5/1996 Gras et al. ..... 123/470

5,575,263 11/1996 Pontoppidan et al. ..... 123/470

5,577,480 11/1996 Gmelin et al. ..... 123/470

*Primary Examiner*—Raymond A. Nelli

*Attorney, Agent, or Firm*—Edwin E. Greigg; Ronald E. Greigg

[57] ABSTRACT

A fuel injection valve for internal combustion engines, having a pistonlike valve member, which is axially displaceably guided in a valve body that is braced axially by means of an adjusting nut against a valve retaining body. To avoid breakage of the valve body in a region of an inlet opening of an fuel inlet conduit into a pressure chamber on the valve body, which region is subject to very high pressure forces, a stop face formed by the end face toward the combustion chamber, of the adjusting nut and a counterpart stop, that cooperates with the stop face, in the housing of the engine and also the annular shoulder of the adjusting nut that encompasses the valve body and the annular step, cooperating with the annular shoulder, of the valve body are embodied conically.

8 Claims, 1 Drawing Sheet

FUEL INJECTION VALVE FOR INTERNAL COMBUSTION ENGINES

PRIOR ART

The invention is based on a fuel injection valve for internal combustion engines. In conventional fuel injection valves of this type, the fuel inlet conduit extends in the valve body obliquely to the center axis, next to the guide bore for the valve member (nozzle needle) extending coaxially with the center axis, and laterally intersects the pressure chamber, which is embodied as an undercut. Because of the slanting course of the inlet conduit, the wall of the valve body has only a slight thickness between the inlet conduit and the guide bore, near where the inlet conduit discharges into the pressure chamber. A further factor is that the wall of the valve body surrounding the pressure chamber, because of the width needed for distributing the fuel, has the least thickness and strength. At injection pressures of up to 400 bar, no significant damage occurs in known fuel injection valves. At higher injection pressures, which in modern direct-injection internal combustion engines have been increased to about 1800 bar, breakage at the end of the partition between the guide bore and the inlet conduit (that is, in the nip) of the pressure chamber can occur, which progresses over time and can lead to the destruction of the valve body of the injection valve. Such breaks are due especially to the high dynamic internal pressure load, compared with the static tension with which the valve body is pressed by the adjusting nut against the valve retaining body, and the injection valve itself is pressed by the adjusting nut against a counterpart stop in the engine housing. In fuel injection valves that are combined directly with a high-pressure pump, which are known as unit fuel injectors, a further factor is that in the pressure buildup, the axial housing pressure of the pump is transmitted to the valve member body via the retaining body.

To lessen the danger of breakage of the valve body in the region of the pressure chamber, it is known to weaken the wall surrounding the pressure chamber as little as possible. To that end, instead of the circular widening of the pressure chamber, an eccentric recess is disposed only at the discharge region of the fuel inlet conduit (U.S. Pat. No. 3,511,442), so that the inclined guidance of the fuel inlet conduit can be made as steep as possible. It is also known to guide the fuel inlet conduit parallel to the guide bore, up to the level of the pressure chamber, and from there on to connect it to the relatively closely guided pressure chamber through a radial, or only slightly steep, or curved connecting conduit (European patent disclosures EP-A 425 236 and EP-A 363 142). Producing such a connecting conduit, however, is complicated and very expensive.

From German Patent Disclosure DE-OS 41 42 430, a fuel injection valve is also known in which the annular shoulder of the adjusting nut that axially braces the valve body against the retaining body is embodied conically on the end of the nut remote from the retaining body. However, this known fuel injection valve also has the disadvantage that widening of the adjusting nut can occur from the axial strain caused when the entire fuel injection valve is fastened in the housing of the engine, so that the compressive force exerted by the adjusting nut in the direction of the pressure chamber cannot contribute substantially to stabilizing the valve body wall.

ADVANTAGES OF THE INVENTION

The fuel injection valve according to the invention for internal combustion engines has the advantage over the prior art that even at very high pressures (about 1800 bar) in the pressure chamber, breakage of the valve body can be reliably avoided.

This is advantageously achieved by the combination of the two conically embodied fuel introduction faces (two chamfers) between the adjusting nut and the valve body and the engine housing and the valve body; as a result, both the bracing force of the adjusting nut when the valve body is braced against the retaining body and the fastening force when the entire injection valve is fastened into the housing of the engine are introduced to the valve body in such a way that there they jointly counteract the compressive force of the pressure chamber, which is at high fuel pressure, especially in the region of the nip at the inlet to the fuel inlet conduit.

The conical embodiment of the contact face on the adjusting nut and of the counterpart stop face in the engine housing has the effect in particular that a large portion of the fastening force exerted on the fuel injection valve is converted into a radial component, which is transmitted directly to the conical annular step of the valve body in the region of the nip, thus counteracting a possible upsetting deformation of the valve body in the critical region caused by the very high dynamic compressive strains.

In this way, the resultant force component originating in the pressure chamber is effectively intercepted by the fastening forces brought to bear, so that the danger of breakage of the valve body can be minimized, which considerably increases the durability of the entire fuel injection valve at high operating pressure.

In addition, because of the conical embodiment of the contact face between the adjusting nut and the engine housing, widening of the adjusting nut from the fastening forces is counteracted.

For optimal fuel transmission, it is advantageous if the conical faces are embodied as uniform conical faces that have the same angle of inclination; the described effect is then attainable even if the transitions are not uniform, for instance being curved.

An especially favorable force transmission to the valve body is attained at an angle of inclination of the conical faces (chamfer) of about 10° to 60°, preferably 30°; a vertical to the conical surfaces then points in the direction of the nip at the transition from the guide bore to the pressure chamber.

Further advantages and advantageous features of the subject of the invention can be learned from the specification, drawing and claims.

BRIEF DESCRIPTION OF THE DRAWING

An exemplary embodiment of the fuel injection valve according to the invention for internal combustion engines is shown in the drawing and will be described in detail hereinafter.

DETAILED DESCRIPTION OF THE EXEMPLARY EMBODIMENT

Figure 1:
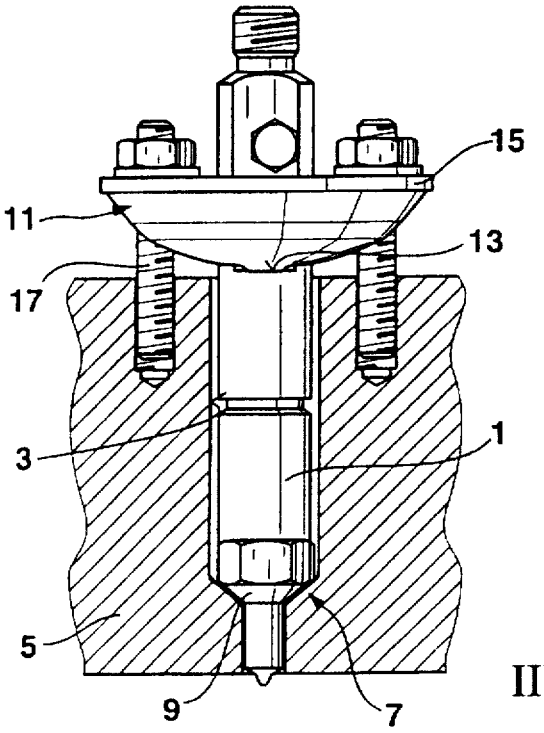
FIG. 1 shows the installation position of the fuel injection valve into the engine housing.

FIG. 1 shows a cylindrical fuel injection valve 1, which is inserted into a receiving bore 3 of a housing 5 of the internal combustion engine to be supplied. The receiving bore 3 is embodied as a stepped bore, whose conically embodied cross-sectional transition forms a counterpart stop face 7. The fuel injection valve 1 is axially braced against this counterpart stop 7 by a fastening device 11, by means of a conical contact face 9 likewise formed by a cross-sectional constriction. The fastening device 11 to that end, in the exemplary embodiment described, has a tightening plate 15, which acts upon an end face 13 remote from the housing of the fuel injection valve 1 and can be fastened to the housing 5 by means of a plurality of tightening screws 17 distributed over its circumference, and which thus firmly fastens the fuel injection valve 1 so that it is axially braced against the counterpart stop 7 in the housing 5 of the engine.

Figure 2:
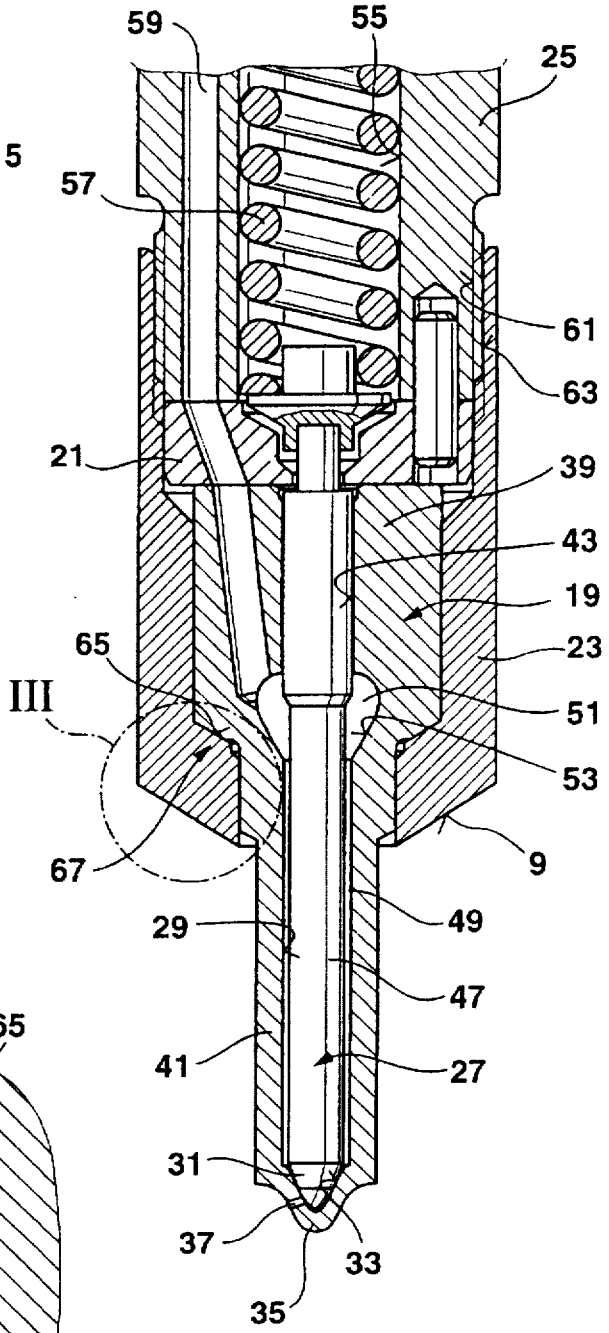
FIG. 2 is a longitudinal section through the portion of the fuel injection valve toward the combustion chamber.

The fuel injection valve 1, shown in FIG. 2 in a section in its region toward the combustion chamber, has a valve body 19, which is secured to a valve retaining body 25 with the interposition of a shim 21 and a sleevelike adjusting nut 23. A valve member 27 (valve needle) in the form of a stepped piston is displaceable in an axial bore 29 of the valve body 19; the valve member 27 has a conical valve sealing face 31, on its end toward its combustion chamber, with which it cooperates with an inward-pointing valve seat 33 in a cusp 35 toward the combustion chamber of the valve body 19; a plurality of injection openings 37 follow the valve seat on the downstream side.

The valve body 19 is embodied as a rotational body, with an upper, thick portion 39 and a lower, slender portion 41, whose end toward the combustion chamber is closed off by the cusp 35. The part of the bore 29 located in the upper portion 39 is embodied as a guide portion 43 for a guide portion 45 of larger cross section of the valve member 27. The part of the bore 29 extending in the lower portion 41, together with the shaft 47 of the valve member 27, defines an annular gap 49 that extends as far as the valve seat 33. In the upper portion 39 of the valve body 19, near the lower portion 41 and between the guide portion 43 of the bore 29 and the annular gap 49, there is an undercut pressure chamber 51 of widened diameter, whose outer boundary 53 is preferably curved and merges with the annular gap 49.

A valve closing spring 57 disposed in a blind bore 55 of the valve retaining body 25 presses the valve member 27 onto the valve seat 33 in the closing direction, in the closed state of the injection valve 1.

For fuel delivery, a fuel inlet conduit 59 that can be made to communicate with a high-pressure injection line, not shown, extends through the valve retaining body 25, the shim 21, and the upper, thick portion 39 of the valve body 19, beginning at the upper face end thereof, extending beside the guide portion 43 of the bore 29 to the pressure chamber 51. The fuel inlet conduit 59 intersects the pressure chamber 51 laterally at the top, forming a nip; the fuel inlet conduit 59 extends obliquely to the guide portion 43, so that the diameter of the pressure chamber 51 can be kept as small as possible and so the cross section at the mouth can be kept as large as possible.

Figure 3:
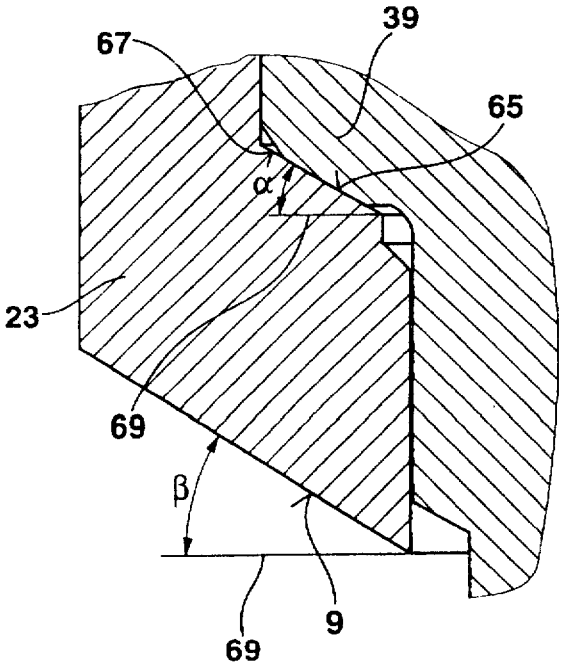
FIG. 3 shows a detail of the fuel injection valve of FIG. 2 on a larger scale.

The adjusting nut 23, embodied as a union nut, which fits over the upper portion 39 of the valve body 19, is screwed by a female thread 61 onto a male thread 63 on the valve retaining body 25 and has an inner annular shoulder 65, on which the valve body 19 is braced with an annular step 67 at the transition from the upper portion 39 to the slender portion 41. The annular shoulder 65 and the annular step 67 are conical, and preferably frustoconical, that is, shaped like truncated cones, with the same angle of inclination a (FIG. 3) to a radial plane 69 that intersects the axis of the valve member 27 at a right angle.

According to the invention, in addition, the stop face 9 of the fuel injection valve 1 formed on the end face toward the combustion chamber of the adjusting nut 23 and the counterpart stop face 7, shown in FIG. 1 and forming part of the receiving bore 3, in the housing 5 of the engine are embodied conically, preferably frustoconically. The angle of inclination $\beta$, shown on a larger scale in FIG. 3, of these conical surfaces to a radial plane 69 that intersects the axis of the valve member 27 at a right angle should preferably be equal to the angle of inclination $\alpha$ at the annular shoulder 65 and the annular step 67. The angles $\alpha$ and $\beta$ should be embodied such that a vertical to the conical surfaces 65, 67, 7, 9 points in the direction of the transition from the guide portion 43 of the bore 29 to the pressure chamber 51, or the inlet opening of the fuel inlet conduit 59 into the pressure chamber 51. The angles of inclination $\alpha$ and $\beta$ to that end have a size ranging from 10° to 60°, preferably 30°, from the radial plane 69.

When the valve body 19 is axially braced against the valve retaining body 25 by the adjusting nut 23, and when the entire fuel injection valve 1 is axially fastened firmly in the housing 5 of the engine by the fastening device 11, not only the axial bracing forces but also radial forces are introduced to the valve body 19 because of the conical contact faces 65, 67, 7, 9, acting as force introduction faces, and these forces counteract the compressive forces and strains produced as pressure is imposed on the fuel injection valve 1 by the internal pressure in the pressure chamber 51. Because of the embodiment of the angles $\alpha$ and $\beta$ at the conical surfaces, these opposed forces are in particular carried into the region of the nip that is especially critical for breakage, near the mouth of the fuel inlet conduit 59 into the pressure chamber 51.

It is thus possible in a structurally simple way with the fuel injection valve of the invention to reduce the danger of fatigue breakage of the valve body in the region of the pressure chamber to a minimum, even at very high operating pressures, without increasing the wall thickness and thus to increase the service life of the entire fuel injection valve.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines, having a valve body (19) firmly fastened to a valve retaining body (25), a valve member (27) is guided axially displaceably in a guide bore (29) of said valve body, said guide bore (29, 43) is adjoined by a radially widened pressure chamber (51), at least one fuel inlet conduit (59), extending next to the guide bore (29, 43) in the valve body (19) discharges into said pressure chamber (51), an adjusting nut (23), said adjusting nut rests with an inner, conically embodied annular shoulder (65) on a conical annular step (67), disposed at a level of the pressure chamber (51) of the valve body (19), said adjusting nut presses the valve body against the valve retaining body (25), a fastening device (11) acts axially on the valve retaining body (25) and braces the fuel injection valve by means of contact of a contact face (9), formed on an end face of the adjusting nut (23) remote from the valve retaining body (25), against a counterpart stop (7) formed in the housing (5) of the engine, the contact face (9) of the adjusting nut (23) and the counterpart stop (7) in the engine housing (5) are embodied conically in such a way that in addition to the axial bracing, a radial strain component is transmitted to the valve body (19) at the level of the pressure chamber (51).

2. The fuel injection valve of claim 1, in which the surfaces of the conical annular step (67) of the valve body (19), the conical annular shoulder (65), and the conical contact face (9) on the adjusting nut (23) and the counterpart stop (7) of the housing (5) are all embodied such that a vertical line relative to them points in a direction of a transition of the guide bore (29, 43) into the pressure chamber (51).

3. The fuel injection valve of claim 1, in which the conical annular step (67) of the valve body (19), the conical annular shoulder (65), and the conical stop face (9) of the adjusting nut (23), as well as the conical counterpart stop (7) of the housing (5), each have the same angle of inclination (α, β) to a radial plane (69) of the fuel injection valve that intersects an axis of the valve member (27) at a right angle.

4. The fuel injection valve of claim 3, in which the angle of inclination (α, β) is in a range from about 10° to about 60° relative to the radial plane (69).

5. The fuel injection valve of claim 4, in which the angle of inclination (α, β) is about 300 relative to the radial plane 69°.

6. The fuel injection valve of claim 1, in which the conical annular shoulder (65) of the adjusting nut (23) and the conical counterpart stop (7) in the housing (5) are embodied as hollow truncated cones, and the conical annular step (67) of the valve body (19) and the conical contact face (9) of the adjusting nut (23) are embodied as frustoconical.

7. The fuel injection valve of claim 1, in which the fastening device (11) has a component (15) that acts axially on the valve retaining body (25) in the direction of the engine housing (5), said component (15) in turn is braced axially against the valve retaining body (25) by at least one securing means, (17), that is fastened into the housing (5).

8. A fuel injection valve of claim 7 in which said at least one securing means is at least one tightening screw.

* * * * *